US006918505B2

(12) United States Patent
Gifford, Sr.

(10) Patent No.: US 6,918,505 B2
(45) Date of Patent: Jul. 19, 2005

(54) FASTENER FOR LINER BAG IN WASTE RECEPTACLE

(76) Inventor: Robert W Gifford, Sr., 1411 Kittanning Pike, Karns City, PA (US) 16041

( * ) Notice: Subject to any disclaimer, the term of this patent is extended or adjusted under 35 U.S.C. 154(b) by 0 days.

(21) Appl. No.: 10/347,544

(22) Filed: Jan. 21, 2003

(65) Prior Publication Data

US 2004/0140310 A1 Jul. 22, 2004

(51) Int. Cl.[7] ..... B65F 1/06
(52) U.S. Cl. ..... 220/495.1; 220/495.11; 220/495.08; 220/908

(58) Field of Search ..... 220/495.11, 495.1, 220/495.08, 495.06, 908; 24/556; 248/95

(56) References Cited

U.S. PATENT DOCUMENTS 2,131,081 A * 9/1938 Wareing ..... 24/556
2,501,214 A * 3/1950 Duket ..... 24/68 R
4,919,374 A * 4/1990 Julian ..... 248/95

* cited by examiner

*Primary Examiner*—Stephen Castellano

(57) ABSTRACT

A fastener device in the form of a generally U-shaped wire clip for manual application to temporarily cause a plastic bag liner to be held in inserted position in a waste container and to also serve as a twist-tie closure for the plastic bag.

4 Claims, 3 Drawing Sheets

FASTENER FOR LINER BAG IN WASTE RECEPTACLE

BACKGROUND OF THE INVENTION

This invention relates generally to liner bags for waste receptacles, and more particularly pertains to a fastener device and a method for its use in retaining a plastic liner bag in its waste-receiving disposition within a waste receptacle.

It is currently common practice at commercial and household locations to provide waste receptacles, often commonly referred to as wastebaskets, with plastic liners in the form of bags which are manually removable and replaceable as required. It is quite common to use a small waste receptacle formed of plastic and located in a bathroom and to use a larger size but similar receptacle in other desired household locations, the best example perhaps being the household kitchen area. Such a receptacle is commonly provided with a plastic bag or liner that is fitted substantially within the receptacle whereby an outer flap end of the bag extends outwardly and over the receptacle's rim. It is uncommon for such a bag to be of a size to fit firmly and tightly in its installed position in the receptacle; most often the bag is relatively large compared to the receptacle whereby a major portion of the bag fits loosely within the receptacle and there is a bag end flap that extends outwardly and downwardly relative to the peripheral rim of the receptacle. Depending on the nature of the waste or refuse deposited in the lined receptacle, it is not unusual and is quite objectionable for the bag to be dislodged from its original installed position such that the outer flap end shifts downwardly within the receptacle.

Dislodgement of the bag is a problem because additional trash deposited in the receptacle tends to cover over and conceal the bag flap within the receptacle and cause removal of the bag to be inconvenient. The person doing so must thrust his or her hands into the receptacle and into the trash contained therein in order to grasp the flap and withdraw the bag.

SUMMARY OF THE INVENTION

This invention comprehends a fastener device for temporarily fastening a plastic bag or liner in position on a trash receptacle. The fastener device is formed from a length of malleable wire of uniform diameter. The device is a one-piece clip having a curved intermediate loop portion and a pair of straight spaced-apart coextensive leg portions. The device is preferably of the size of a No. 2 paper clip. The leg portions are integral to and project from the curved loop portion equidistantly, in a common plane from the curved loop portion.

The fastener device is utilized in combination with a plastic bag and a trash receptacle. The receptacle is the type typically found in a home or commercial establishment, having a body portion with an upwardly-facing opening defined by a rim. The plastic bag is contained substantially within the trash receptacle as a liner and has a flap portion extending outside the rim and outwardly and downwardly therefrom, against the peripheral sidewall of the receptacle which is immediately subjacent the rim.

The method of utilizing the fastener or clip device in combination with the receptacle and its plastic bag liner involves a person manually grasping the device in a manner similar to holding an ignition key for an automobile and firmly thrusting the device against the outer flap such that the ends of the legs pierce the flap and contact the outer sidewall of the receptacle, and then manually twisting the device whereby the plastic bag bunches and gathers about the legs of the device, causing the flap to contract snugly against the outer wall of the receptacle. With the legs of the device engaged in the liner flap material, the outwardly-extending portion of the device is manually bent and deformed upwardly and over the receptacle rim whereby it conforms to the rim shape such that the loop portion of the device points downwardly into the receptacle and is firmly wedged against the inside receptacle surface and the overlying liner. A fastening action is thus completed, with the device being left in the position described until such time as it is desirable to remove the filled plastic liner from the receptacle. The removal action involves manually bending the clip back toward its original disposition whereby it can be withdrawn from its engagement with the bag flap portion and then, if desired, it can be used as a twist-tie about the end of the closed plastic bag prior to discarding the bag as refuse.

DETAILED DESCRIPTION OF THE PREFERRED EMBODIMENTS

Figure 1:
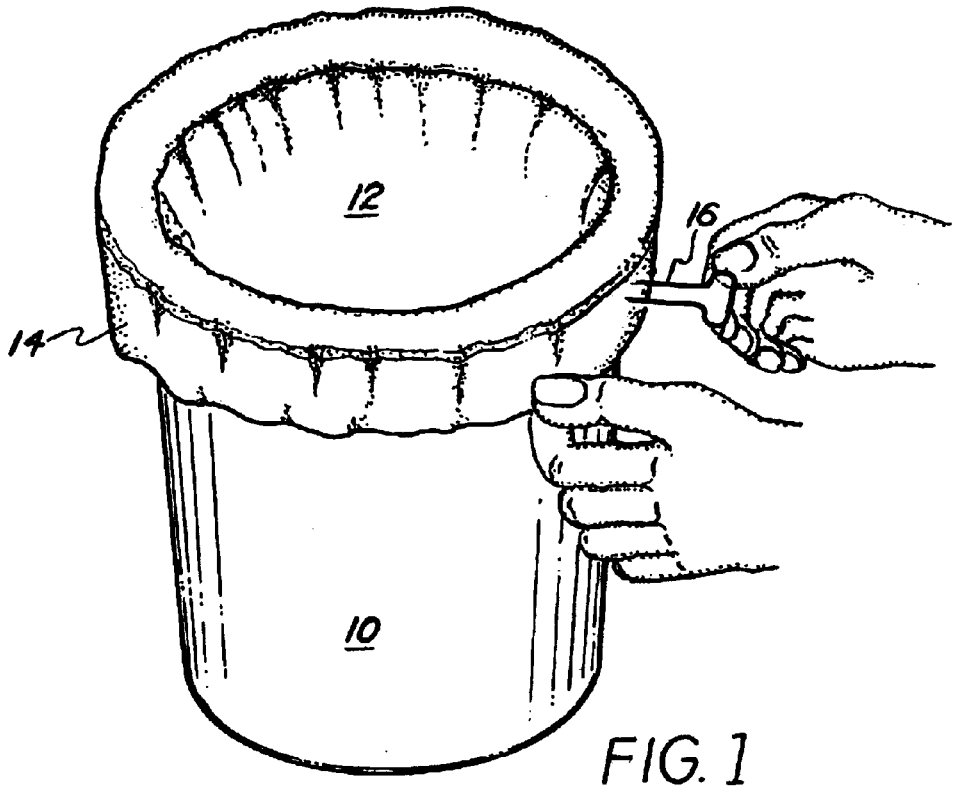
FIG. 1 is a perspective view of a trash receptacle containing a plastic bag liner, illustrating a first embodiment of a fastener device utilized in accordance with the present invention.
Figure 2:
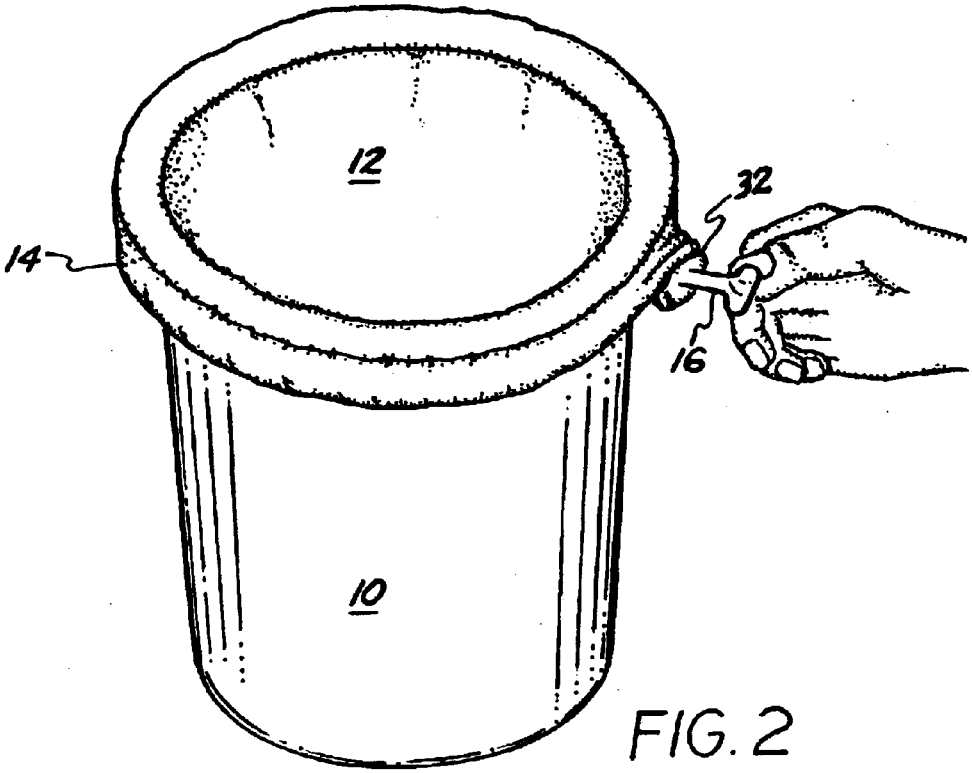
FIG. 2 is a perspective view of the receptacle and plastic liner first shown in FIG. 1 and illustrating the disposition of the fastener or clip device first shown in FIG. 1 as it is utilized in accordance with the present invention.

FIGS. 1 and 2 show a trash receptacle or wastebasket 10 containing substantially within it a liner or plastic bag 12. The bag 12 has an outer flap or end 14 extending over the rim of the receptacle 10, the rim being hidden beneath the flap 14. A fastener device in the form of a clip 16 is shown in FIG. 1 being manually applied in a disposition transverse to the sidewall of the basket 10.

Figure 3:
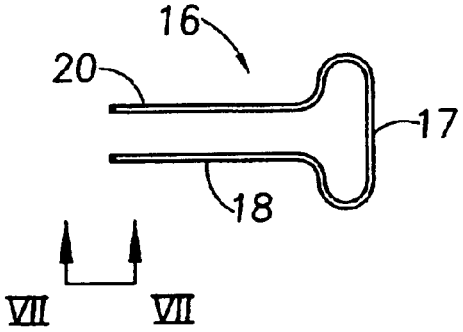
FIG. 3 is an elevational view of the fastener device first shown in FIG. 1 but shown in comparatively larger actual scale.
Figure 4:
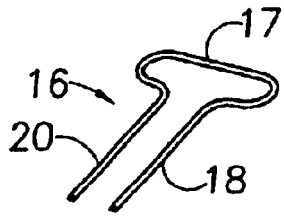
FIG. 4 is a perspective view of the fastener device shown in FIG. 3.
Figure 5:
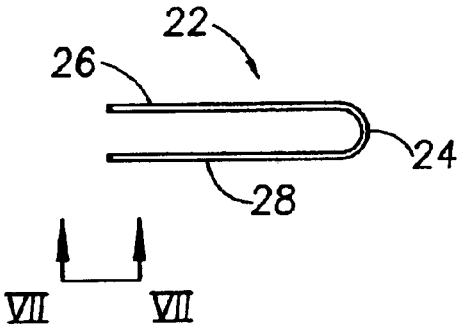
FIG. 5 is an alternate shape constituting a second embodiment of a fastener device in accordance with the present invention.
Figure 6:
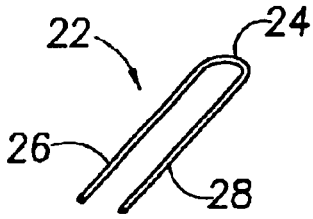
FIG. 6 is a perspective view of the device first shown in FIG. 5.

FIGS. 3 and 4 illustrate one embodiment of the fastener device or clip 16 having a looped portion 17 and extending legs 18 and 20. FIGS. 5 and 6 show a slightly different shape for a fastener device or clip in accordance with the present invention, the clip 22 having a loop portion 24 with integral leg portions 26 and 28 projecting from the loop portion 24 an equal distance and in parallel relationship to each other.

Figure 7:
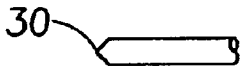
FIG. 7 is an elevational view of an enlarged segment of either the device shown in FIG. 3 or the device shown in FIG. 5, as taken along lines VII—VII of either FIG. 3 or FIG. 5.

The clips 16 and 22 are preferably formed from a malleable wire having the general characteristics of the wire in a jumbo or No. 2 paper clip. The clips 16 and 22 may be manually bent in accordance with the method of utilizing the invention and will hold the form to which each is manually bent until such time as manual force may be reapplied to alter the configuration. As shown in FIG. 7, the outer or distal end of the legs 18, 20, 26, and 28 may be provided with a sharpened end point 30 to facilitate the use of the clip as hereafter described.

Figure 8:
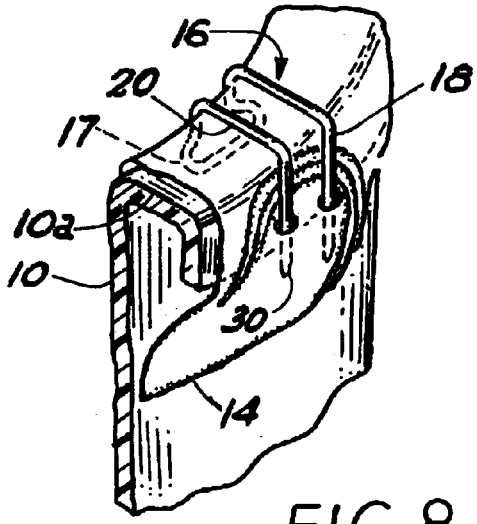
FIG. 8 is a perspective fragmentary view illustrating the final disposition of the fastener device relative to the receptacle and plastic bag first shown in FIGS. 1 and 2.

Clip 16 is shown in an operative or functional position in FIGS. 1, 2, 8, and 9. The clip 16 is grasped in an individual's hand and placed substantially as shown in FIG. 1 whereby the ends of the legs 18 and 20 pierce and penetrate through the flap 14 and come to rest against the outer surface of the receptacle 10 just below the circular rim of the receptacle 10. A twisting or rotative action is applied to the clip 16 whereby the adjacent flap material is caused to bunch and gather into a clump 32 encircling the legs of the clip 16. The foregoing manual action pulls the flap tightly against the outer sidewall of the receptacle 10 so the bag is prevented from slipping downwardly into the receptacle as a result of trash being dropped into the receptacle. Then, the outwardly-extending loop portion 17 of the fastener device 16 is manually bent upwardly and over the flap 14 and rim 10*a* of the receptacle 10, as shown in FIG. 8. The clip 16 is thus bendably formed over and against the receptacle rim whereby the loop 17 extends downwardly within the receptacle to hold the flap 14 in place as FIG. 8 illustrates.

Having heretofore described the utilization of the fastening device 16 in combination with the receptacle 10 and plastic bag 12, it should be clearly understood that the simplified shape of the fastening device 22 shown in FIGS. 5 and 6 would be employed in the same manner as described with reference to the fastening device 16 to temporarily fasten a plastic bag in its installed position on the receptacle 10.

The receptacle 10 shown in the drawings is only an example of one shape of a receptacle to which the present invention may be applied. Other common receptacles are rectilinear in cross-section and/or smaller or larger, depending upon location and intended use. There is no reason why the inventive concept herein disclosed would not be applicable to a substantially large heavy-duty plastic bag used in a garbage can or similar outdoor container or with other receptacle configurations used commercially and industrially.

Figure 9:
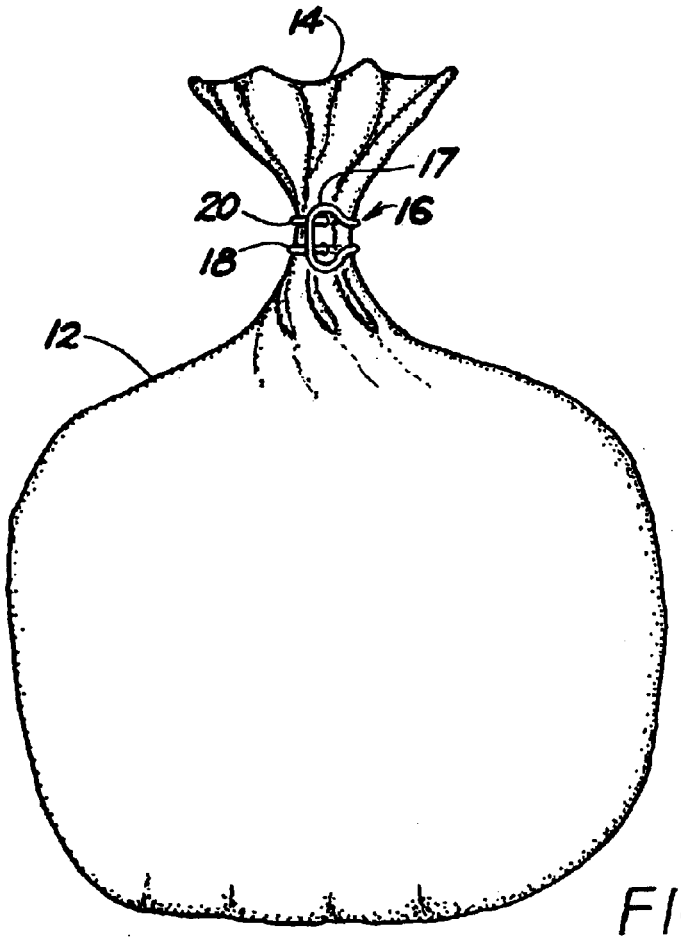
FIG. 9 is an elevational view in reduced scale showing a plastic trash bag and showing a selective final disposition of the fastener device shown in FIGS. 1–4.

FIG. 9 is an illustration of a plastic bag after it has been withdrawn from its support receptacle and having the fastening device 16 reshaped to close the bag, the illustration showing the device 16 twisted about the neck of the bag 12 to act as a twist-tie closure means on a trash-filled bag prior to its disposal.

While the foregoing description has shown and described the fundamental features as applied to the preferred embodiments of the present invention, it will be understood by those skilled in the art that modification embodied in various forms may be made without departing from the spirit and scope of the invention.

What is claimed is:

1. A fastener device for temporarily fastening a plastic bag in position on a trash receptacle, formed from a length of wire of uniform diameter, comprising:

a one-piece manually-twistable clip having a curved loop portion and a pair of straight bendable spaced-apart coextensive leg portions;

the leg portions projecting equidistantly and in substantially parallel relationship to each other and in the same plane from the curved loop portion while in an unbent position;

wherein the trash receptacle is of a type having a body portion with an opening defined by a rim and an exterior surface, a substantial portion of the bag disposed within the body portion and having a flap portion extending outside the rim and wrapped against the rim and the exterior surface of the receptacle;

the clip being manually placed outwardly on the flap with the pair of leg portions positioned transversely to the exterior surface of the receptacle, projecting through the flap and piercing a through hole in the plastic bag and the leg portions are positioned against the exterior surface of the receptacle; and an area of the flap circumjacent the clip leg portions encircling the leg portions after a manual twisting action having been applied to the clip whereby the flap is drawn tightly against the exterior surface of the receptacle.

2. The fastener device of claim 1 wherein the curved loop portion has a lateral dimension greater than a lateral distance between the leg portions.

3. The fastener device of claim 1 wherein the clip is deformably bent over the rim whereby the loop portion projects inside the receptacle and against a point on the plastic bag to hold it tightly against an inside surface of the body portion adjacent the rim and the pair of bendable straight leg portions bent about the rim of the receptacle.

4. The fastener device of claim 1, wherein twisting of the clip causes the plastic bag to bunch and gather into a clump encircling the leg portions of the clip.

* * * * *